US007870968B2

(12) United States Patent
Hanson

(10) Patent No.: US 7,870,968 B2
(45) Date of Patent: Jan. 18, 2011

(54) BOTTLE WITH DISPOSABLE BOTTLE CAP HOLDER

(76) Inventor: Scott Ray Hanson, 7901 Tylerton Dr., Raleigh, NC (US) 27613

( * ) Notice: Subject to any disclaimer, the term of this patent is extended or adjusted under 35 U.S.C. 154(b) by 233 days.

(21) Appl. No.: 11/957,478

(22) Filed: Dec. 16, 2007

(65) Prior Publication Data

US 2009/0152231 A1 Jun. 18, 2009

(51) Int. Cl.
*B65D 55/16* (2006.01)
*B65D 23/12* (2006.01)

(52) U.S. Cl. ..... 215/306; 215/390; 220/379; 220/744

(58) Field of Classification Search ..... 215/306, 215/390; 220/379, 744, 735, 736
See application file for complete search history.

(56) References Cited

U.S. PATENT DOCUMENTS

| | | | | | |
|---|---|---|---|---|---|
| 1,572,505 | A * | 2/1926 | Raymond | 220/379 |
| 2,744,649 | A * | 5/1956 | Smith | 215/390 |
| 2,957,596 | A * | 10/1960 | Rehborg | 215/386 |
| 4,129,236 | A * | 12/1978 | Wrycraft et al. | 222/570 |
| 5,165,563 | A * | 11/1992 | McKendry | 220/254.8 |
| 5,211,299 | A * | 5/1993 | Manfredonia | 215/11.1 |
| 5,244,106 | A | 9/1993 | Takacs | |
| 5,282,541 | A | 2/1994 | Chen | |
| 5,388,712 | A * | 2/1995 | Brody | 215/229 |
| 6,123,210 | A * | 9/2000 | Kim | 215/11.6 |
| 6,131,755 | A * | 10/2000 | Soyka et al. | 215/390 |
| 6,540,111 | B2 | 4/2003 | Sunnarborg | |
| 2003/0121925 | A1 * | 7/2003 | Mowe | 220/736 |
| 2005/0011897 | A1 * | 1/2005 | Stuart | 220/379 |
| 2007/0007235 | A1 * | 1/2007 | Costello | 215/390 |
| 2008/0142466 | A1 * | 6/2008 | Balitski | 215/6 |

FOREIGN PATENT DOCUMENTS

| | | | |
|---|---|---|---|
| JP | 2001-294259 | A | 10/2001 |
| JP | 2004175447 | | 6/2004 |
| JP | 03115076 | U | 11/2005 |
| JP | 200682875 | | 3/2006 |
| KR | 20-0284869 | Y1 | 8/2002 |
| KR | 10-2002-0075345 | A | 10/2002 |

* cited by examiner

*Primary Examiner*—Anthony Stashick
*Assistant Examiner*—Niki M Eloshway
(74) *Attorney, Agent, or Firm*—Jim Passé; Passé Intellectual Property LLP

(57) ABSTRACT

The present invention relates to a beverage bottle with a container cap. In particular the beverage bottle has a reversible means for holding the container cap on the outside of the container during use of the bottle which prevents loss of the cap.

12 Claims, 8 Drawing Sheets

BOTTLE WITH DISPOSABLE BOTTLE CAP HOLDER

COPYRIGHT NOTICE

A portion of the disclosure of this patent contains material that is subject to copyright protection. The copyright owner has no objection to the reproduction by anyone of the patent document or the patent disclosure as it appears in the Patent and Trademark Office patent files or records, but otherwise reserves all copyright rights whatsoever.

BACKGROUND OF THE INVENTION

1. Field of the Invention

The present invention relates to fluid containers and more particularly to a beverage bottle with a container cap with a means for reversibly holding the container cap without replacing the cap on the bottle opening.

2. Description of Related Art

With the advent of larger individual serving beverage bottles, one frequently confronts the issue of what to do with the screw on bottle cap during the drinking process if one is intending to replace the cap when the beverage is only partially consumed. The cap is normally just put down in the nearest place or worse discarded and upon the need to replace the cap either a search ensues or one must wash the cap after retrieval from the garbage.

Another problem with the screw off bottle caps comes during recycling of bottles. It is typical that if the beverage is to be totally consumed that the cap becomes separated and almost never makes the recycling bin for most people. Since billions and billions of bottle caps are not recycled a significant environmental problem exists. While the problem does not exist for pop top cans because the tab stays with the can, no real significant solution is currently in use for bottle caps.

Several solutions have been suggested or are in limited use. One solution to the problems is to outfit a larger soda bottle with a dispensing means. This replaces the cap so the need to reseal with the cap is eliminated. Of course then the cap is disposed of and usually lost. In U.S. Pat. No. 6,540,111 to Sunnaborg, issued Apr. 1, 2003, there is described a bottle and valve system so that the larger bottles like 2 liter types can dispense liquid like a soda fountain. The original cap is removed and the invention provides no instructions with what to do with the original cap.

A bottle cap holder built into a bottle is described in U.S. Pat. No. 5,244,106 to Takacs, issued Sep. 14, 1993. In this invention the bottle has a base with a cap well form in the base having a generally cylindrical shape and configured to receive the cap and hold it in place. The cap well is deeper than the cap is high and firmly grips the cap. While this holder solves some of the problems of the art, it is difficult to retrieve the cap with this holder, if one is going to reseal the beverage container. This is true even with the aid of the finger well also designed into this bottle cap holder for removing the cap. Accordingly, this design has not been adapted into commercial use.

In Japanese patent 2006-82875 there is described a means for holding a bottle cap comprising a clip mounted on the neck of a PET bottle. In Japanese patent 2004-175447 there is disclosed a bottle cap holder for a PET bottle comprising holder which attaches to the neck of the bottle and uses two parallel slits to hold a cap. The slits are spaced the width of the cap and press fit into place. The cap is held by its placement into the two troughs created.

It is clear that there is still a need for a solution to the problems of bottle caps which allow for ease of retrieval of the cap, yet also provide a means to attach the cap easily when disposing the beverage container.

BRIEF DESCRIPTION OF THE INVENTION

The present invention overcomes the problems associated with screw off bottle caps. In particular, the present invention takes advantage of the facts that when squeezing a bottle cap on the outer circumference, the cap opening can be deformed into an oval shape with a long diameter larger than the caps round diameter. Further protrusions can be placed on the bottle and the cap fit over the protrusions in its deformed or non-deformed configuration and then grip or otherwise resist removal when the cap is released over the protrusion. In some embodiments the protrusions each comprise a pair of protrusions. In another embodiment a single pair of protrusions hold the sidewall of the cap or the inner surface of the cap.

An embodiment of the invention therefore includes, a beverage container having an opening sealed by a removable round screw cap, the cap comprising a selected open inner circumference, the container having a cap holder comprising:

a) a first protrusion; and b) a second protrusion;

the first and second protrusions spaced such that the cap open inner circumference fits over the first and second protrusions and contacts the first and second protrusions on a surface of the cap's inner circumference and is held in place.

The present invention also includes a beverage container having an opening sealed by a removable round screw cap, the cap comprising a side wall with a selected side wall thickness, the container having a cap holder comprising:

a) a first protrusion; and b) a second protrusion;

the first and second protrusion spaced apart at no greater than the selected sidewall thickness such that the cap side wall when placed in between the first and second protrusion will be held in place.

The present invention further comprises in an embodiment a beverage container having an opening sealed by a removable round screw cap, the cap comprising side wall with a selected sidewall thickness, the container having a cap holder comprising:

a) a first pair of spaced protrusions; and b) a second pair of spaced protrusion;

each pair spaced to accept a sidewall thickness and the first and second pair spaced to accept a first and second position on the sidewall simultaneously and hold the cap in place.

These and other objects of the present invention will be clear when taken in view of the detailed specification and disclosure in conjunction with the appended figures.

DETAILED DESCRIPTION OF THE INVENTION

Figure 1A:
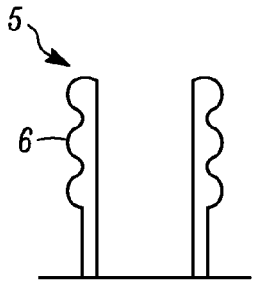
FIG. 1 is a side view of several embodiments of the shape of protrusions of the invention.
Figure 1B:
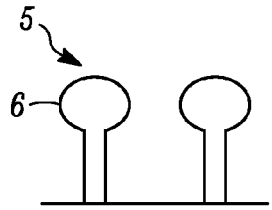
Figure 1C:
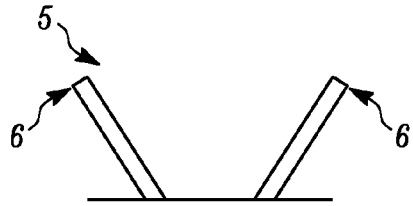
Figure 1D:
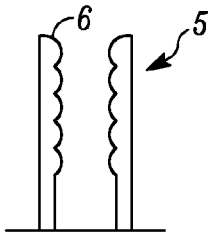
Figure 1E:
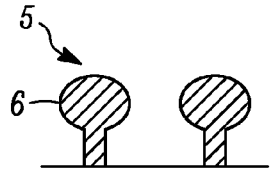
Figure 1F:
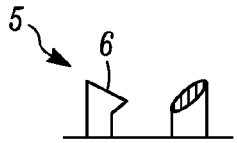

It has been an ever increasing problem that bottle caps become lost or misplaced prior to replacement on a beverage bottle or other liquid bottle prior to storage of a partially full bottle or disposal of an empty bottle. The solutions thus far to retain the cap, available to the art, have not been widely adapted in part because of cost and functionality issues with their design. It has been discovered that because of the unique nature of the bottle cap inner diameter and varying thickness of the cap side wall that placing of a first and second protrusion on the bottle can be used to hold the bottle cap. The present invention thus solves the problems associated with bottle caps in a cost effective and easy to use manner.

While this invention is susceptible of embodiment in many different forms, there is shown in the drawings and will herein be described in detail specific embodiments, with the understanding that the present disclosure of such embodiments is to be considered as an example of the principles and not intended to limit the invention to the specific embodiments shown and described. In the description below, like reference numerals are used to describe the same, similar or corresponding parts in the several views of the drawings. This detailed description defines the meaning of the terms used herein and specifically describes embodiments in order for those skilled in the art to practice the invention.

The terms "a" or "an", as used herein, are defined as one as or more than one. The term "plurality", as used herein, is defined as two or more than two. The term "another", as used herein, is defined as at least a second or more. The terms "including" and/or "having", as used herein, are defined as comprising (i.e., open language). The term "coupled", as used herein, is defined as connected, although not necessarily directly, and not necessarily mechanically.

Reference throughout this document to "one embodiment", "certain embodiments", "and an embodiment" or similar terms means that a particular feature, structure, or characteristic described in connection with the embodiment is included in at least one embodiment of the present invention. Thus, the appearances of such phrases or in various places throughout this specification are not necessarily all referring to the same embodiment. Furthermore, the particular features, structures, or characteristics may be combined in any suitable manner in one or more embodiments without limitation.

The term "or" as used herein is to be interpreted as an inclusive or meaning any one or any combination. Therefore, "A, B or C" means "any of the following: A; B; C; A and B; A and C; B and C; A, B and C". An exception to this definition will occur only when a combination of elements, functions, steps or acts are in some way inherently mutually exclusive.

As used herein "beverage container" refers in general to a container containing a liquid such as a beverage. Typically, soda beverage containers are included which are plastic, clear or tinted bottles often made of acrylics or other plastics for delivering as much as 3 or 4 liters of liquid.

Beverage containers of this kind typically have a small round opening at the top of the bottle sealed by a removable and replaceable round screw cap. The screw cap has an inner circumference usually with screw teeth to match screw teeth on the beverage container opening. The screw cap also has an outer diameter and in some embodiments of screw caps the outer diameter varies at different points in the height of the cap. Likewise the cap has a side wall of a selected thickness and that thickness can be constant or vary in thickness across the height of the screw cap. The variance is often due to manufacturing considerations or due to the attachment ring that holds the screw cap on the beverage container. The screw cap also has a given outer height as well as a selected inner height corresponding to the distance from the inner diameter opening to the inner top of the cap. Caps are generally made of a non-clear plastic and are deformable under finger pressure applied to opposite sides of the outer circumference nearest the opening. Once squeezed, the normally round inner opening circumference becomes oval shaped wherein the longest diameter, the long oval diameter, is now greater than the normal round diameter opening of the cap. The type of plastic that a bottle cap is made from has a certain amount of elasticity and when the cap is squeezed to deform to the oval shape and then released the cap opening tends to return to the round shape. Many bottle caps now have a protrusion or ridge on the outer surface of the diameter right by the cap opening. This has been included in some caps due to the mechanism used to seal the cap on the bottle initially.

By "cap holder" is meant as used herein a means permanently or temporally mounted, molded into or the like on a beverage container designed to hold a beverage screw cap from the same container while the bottle is open for example while pouring or while drinking from the beverage container. The cap is held in place sufficiently that the screw cap will not under normal use be separated from the beverage container.

As used herein the term "protrusion" refers a small nub, column, knob, protuberance or the like which sticks out from the surface of the beverage container. It should be relatively stiff such that it does not deform so much that it loses its holding power against the screw cap. While one skilled in the art could vary the height of the protrusion in one embodiment the protrusion is from about 1 to 5 mm in height. Likewise the diameter of the protrusion which could be round square or any convenient shape needs only be a millimeter or so in thickness though once again one skilled in the art taking into consideration the material the protrusion and container are made from can vary that diameter. The protrusion can be added on to a container or be molded into the surface of the container during the manufacture of the beverage container (for example during blow molding of a container. The location of the protrusions is on the outer surface of the container in such a position that the protrusions or the screw cap mounted on the protrusions does not substantially interfere with the container use. In one embodiment the protrusions are positioned on the shoulder of the bottle (typical that soda containers have a shoulder as depicted in the figures of the present invention).

Each protrusion can also in one embodiment comprise a cap grabbing means. Such a means refers to a shape of the protrusion such that it increases the friction or grabbing efficacy of the protrusion against the surface of the screw cap. Varying diameters, hooks, ruffles, knobs, bulbous ends and the like are embodiments of varying the shape of the protrusion to include a cap grabbing means.

The present invention in one embodiment comprises adding a first and second protrusion to the container. Each protrusion would be sized to have a diameter less than about half the inner diameter of the cap. In one embodiment the diameter of the protrusion is from about 0.5 to about 2 mm. The protrusion can be cylindrical, square or have most any selected number of sides. The height can be any height but in one embodiment the height of the protrusions is less than the inner height of the protrusions so that the cap can if desired rest flush against the surface of the bottle when the holder is used. In choosing and designing the protrusions they should not be either so long or so flexible that when pressure from a cap is applied they deform such that they do not hold the cap.

The protrusions are positioned on the outer surface of the bottle spaced apart so that they are about the size of or about just slightly father apart than the inner diameter of the cap. When the cap is pressed on the protrusions or deformed to the oval it easily fits over the two protrusions but when released over the protrusions and the cap returns to a relaxed round shape the inner surface of the cap or otherwise contacts the protrusion. In one embodiment of the present invention the cap contacts the protrusion hard enough that contact holds the cap in place. In another embodiment the protrusions have a means for creating friction or an obstruction to removing the cap without force or re-deforming the cap. In yet another embodiment the first and second protrusion each consist of a pair of protrusions space such that the opening of the cap can fit such that the cap wall has one of each pair of protrusions position on the inside and one on the outside on essentially opposite sides of the cap.

In yet another embodiment of the present invention there are a pair of protrusions spaced apart just enough to hold the thickness of the sidewall in the screw cap. In such an embodiment only the one side wall is held and the rest of the screw cap is loose.

The protrusions both as single protrusions or pairs of protrusions can be treated to have a means for grabbing the cap by friction or resistance. So for example the protrusions can be textured to grab the cap or in one embodiment the protrusions can have a bulbous end such that when the cap is fully in place over the protrusions and bulbs, the bulbous end creates resistance or obstruction to the caps removal. In one embodiment the bulbous end protrusions are sued on bottles with caps that have the protrusions described above.

The protrusions are positioned anyplace on the outside of the bottle where the cap could be placed. Some places would be more useful than others, so for example while the protrusions could be placed on the bottom of the container, such placement might prevent setting the bottle down. That may or may not be desirable and the decision where to place the protrusions in view of this disclosure is within the skill in the art. One place to consider is someplace that does not interfere with hand placement on the bottle for example the bottle neck or the lower portion of the outside of the bottle.

Now referring to the drawings FIG. 1*a* through 1*f* are examples of protrusions 5 each with a grabbing means 6. In particular they show ruffled portions bulbous ends hooks and the like for use with each of the embodiments of the present invention. These examples are for further indicating the variance within the grabbing means of the invention. One skilled in the art would be able to design other grabbing means in view of these figures and the disclosure of the present invention. These protrusions can be spaced to hold a cap side wall or spaced to hold the inner diameter or be paired with a third and fourth protrusion to form two pairs of protrusions each pair spaced the thickness of the sidewall. It is also clear that more than just two pair of protrusions could be used or more than 2 protrusions within the teaching of the present invention.

Figure 2A:
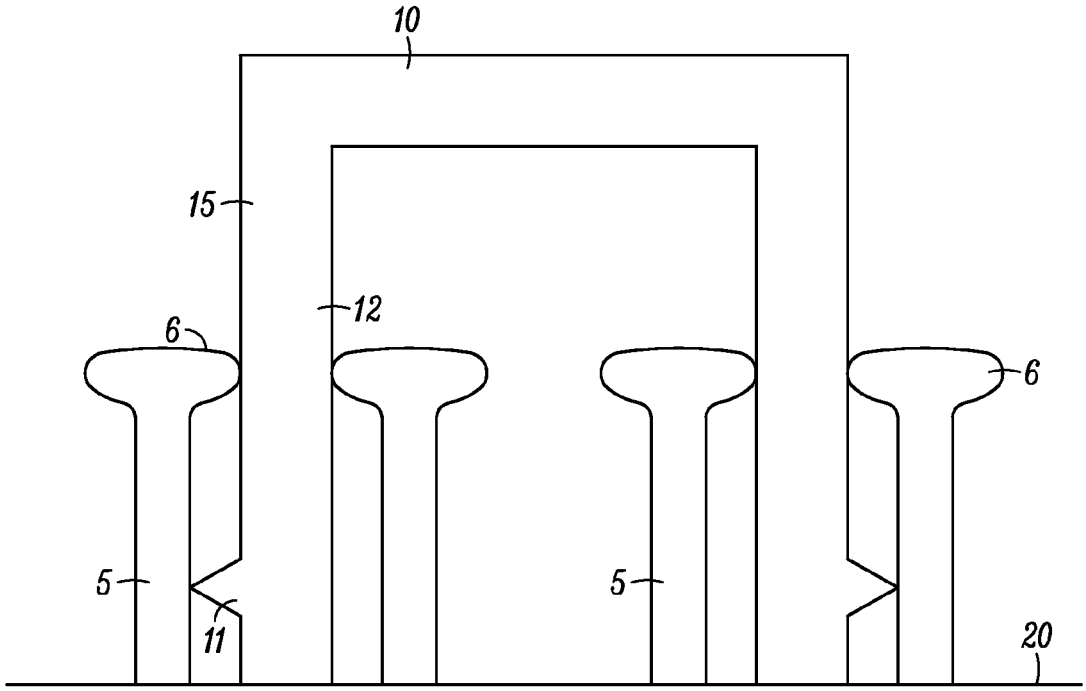
FIG. 2*a*, 2*b*, 2*c* and 2*d* are cut-through side views of 4 different embodiments of the invention with attached cap.

FIG. 2*a* shows a cross section of the present invention cap holder showing a container cap 10 with a portion of the cap sidewall 15 having a variable thickness for example at point 11 and where the cap is contacted 12. There is shown four protrusions 5 each mounted on the surface 20 of a container. This is an embodiment where there are 4 protrusions holding the cap, a pair on each side of cap 10. In this embodiment the cap can be fit directly on the 4 protrusions 5 or can be deformed slightly where they are spaced a bit further apart.

Figure 2B:
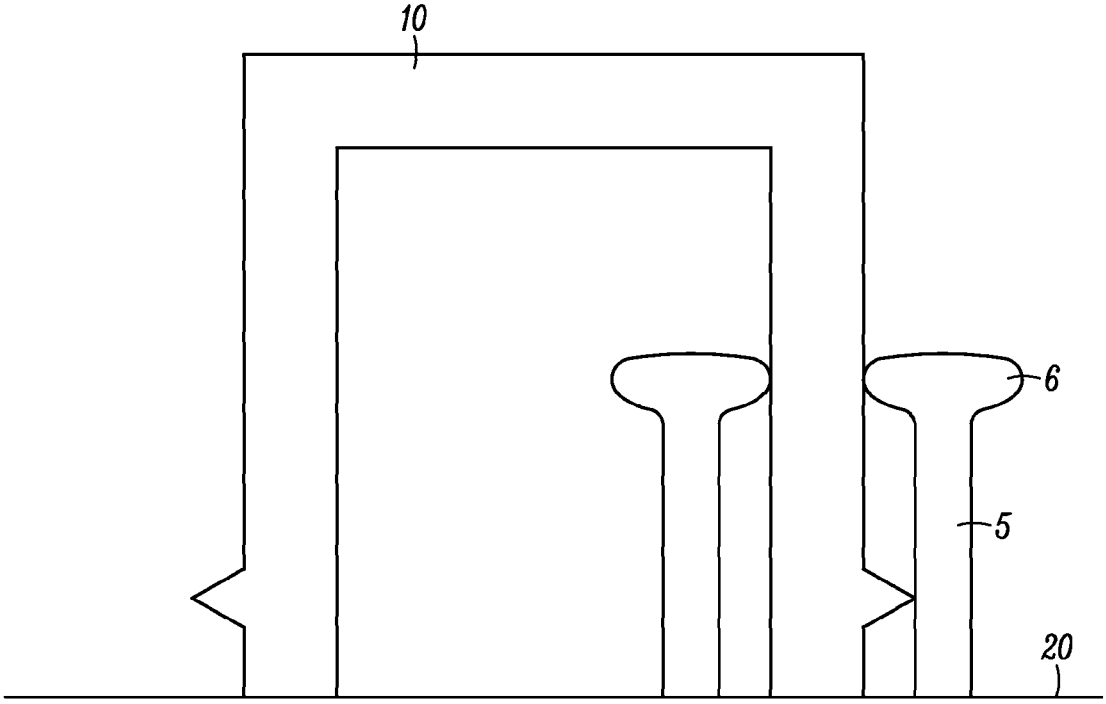

FIG. 2*b* is another embodiment cross section of the present invention with a single pair of protrusions. In this embodiment only one side of cap 10 is being held leaving the rest of the cap 10 free.

Figure 2C:
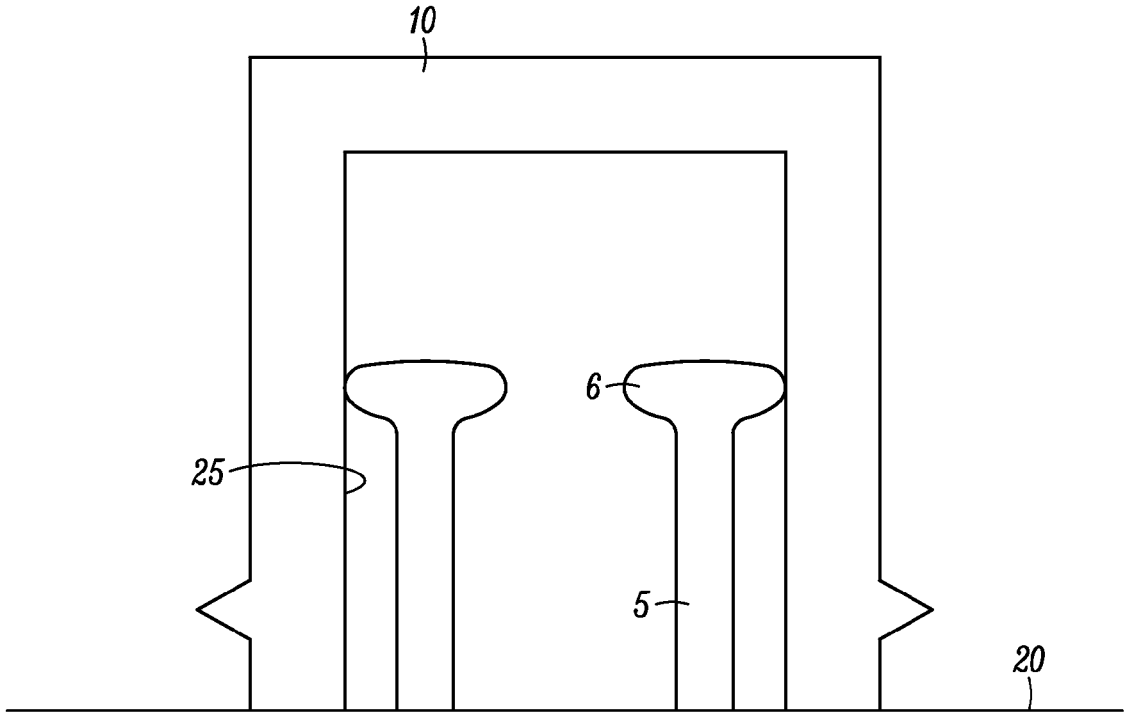

FIG. 2*c* shows yet another cross section of the present invention where there are two protrusions 5 positioned to hold a cap 10 by the inside diameter 25 of cap 10.

Figure 2D:
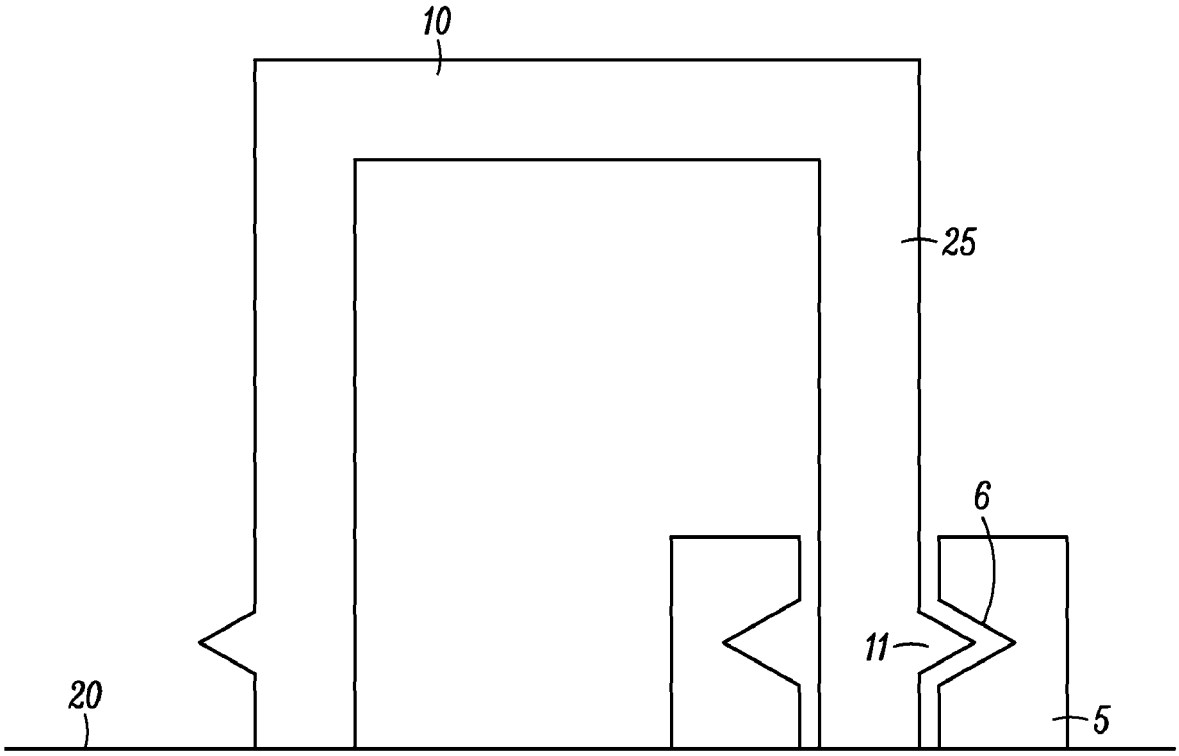

FIG. 2*d* shows another embodiment of the embodiment in FIG. 2*b* where there are two protrusions 5 holding a sidewall 25 of cap 10. In this embodiment the protrusions 5 are much shorter and the cap grabbing means 6 is designed to hold the extra thickness 11 of this particular screw cap (note that the inner diameter screw teeth have not been show for convenience).

Figure 3A:
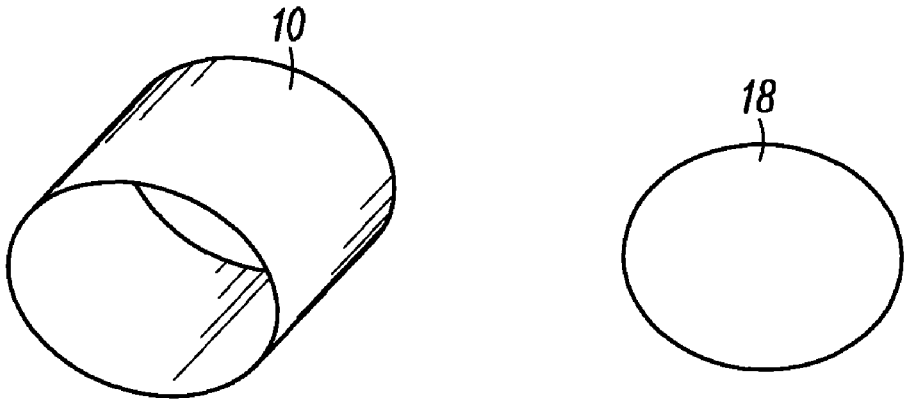
FIGS. 3*a* and 3*b* is a perspective view of the open inner diameter of a bottle cap in its round state versus its oval deformed state.
Figure 3B:
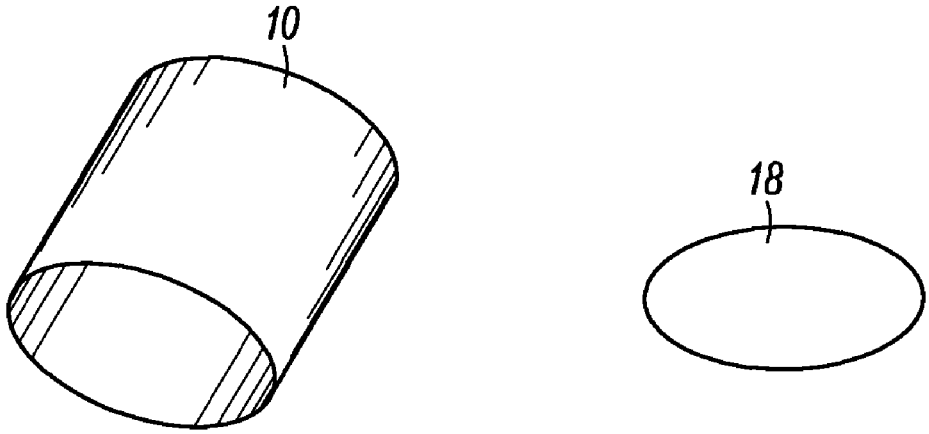

FIG. 3*a* and 3*b* shows a screw cap and its inner diameter shape. In FIG. 3*a* the cap inner diameter 18 is circular and in FIG. 3*b* the diameter 18 is oval where opposing sides of the cap diameter 18 have been squeezed.

Figure 4:
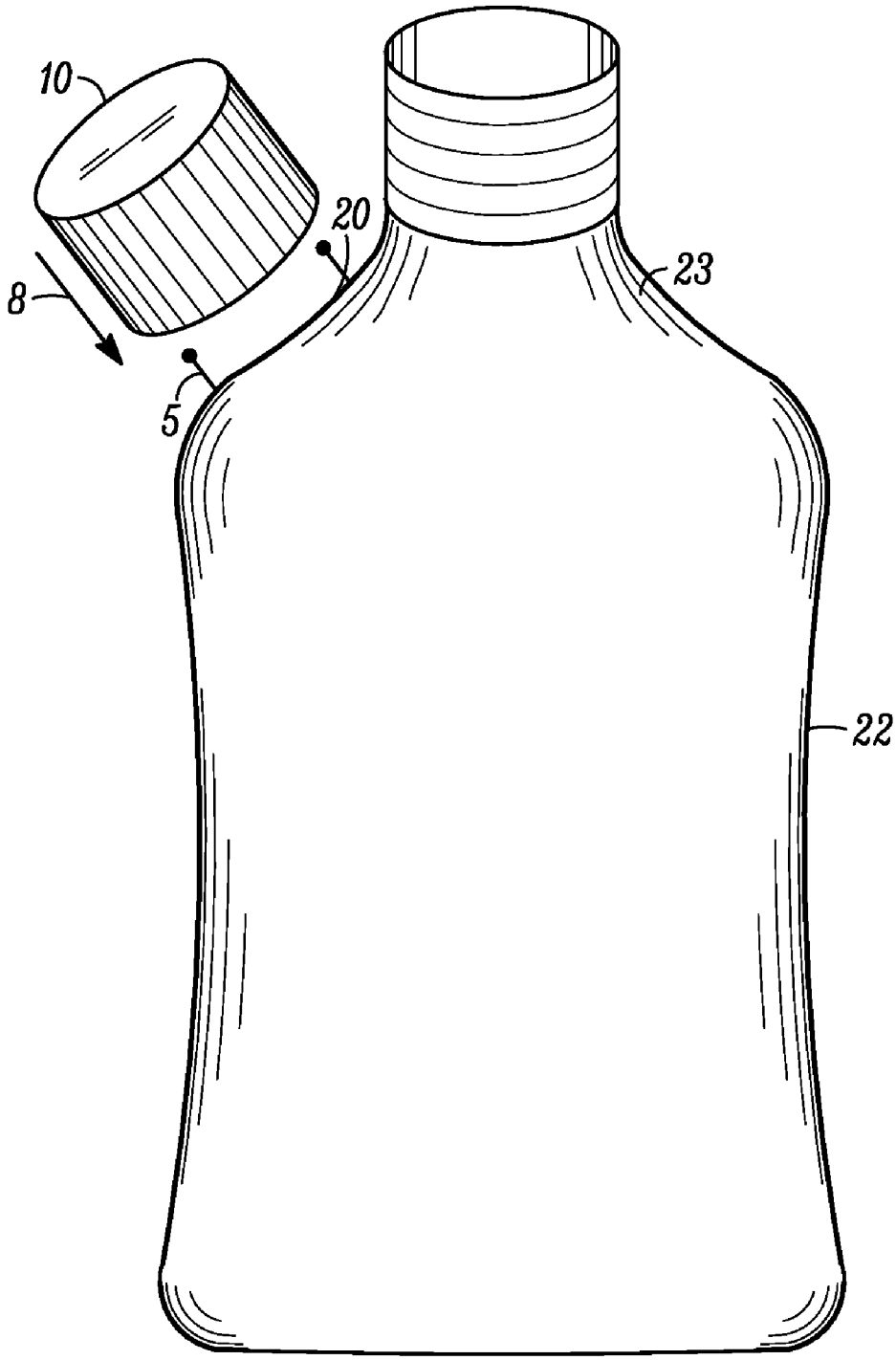
FIG. 4 is a perspective view of a bottle with protrusions holding a bottle cap in place.

FIG. 4 shows a beverage container 22 with container surface 20. In this embodiment the container 22 has two protrusions 5 on shoulder 23 for holding cap 10 on its surface 20. In this embodiment the protrusions 5 hold the cap 10 in the cap 10s inner surface Arrow 8 indicates the direction the cap 10 must move to be placed on the protrusions 5 and held in place on container 22.

Figure 5:
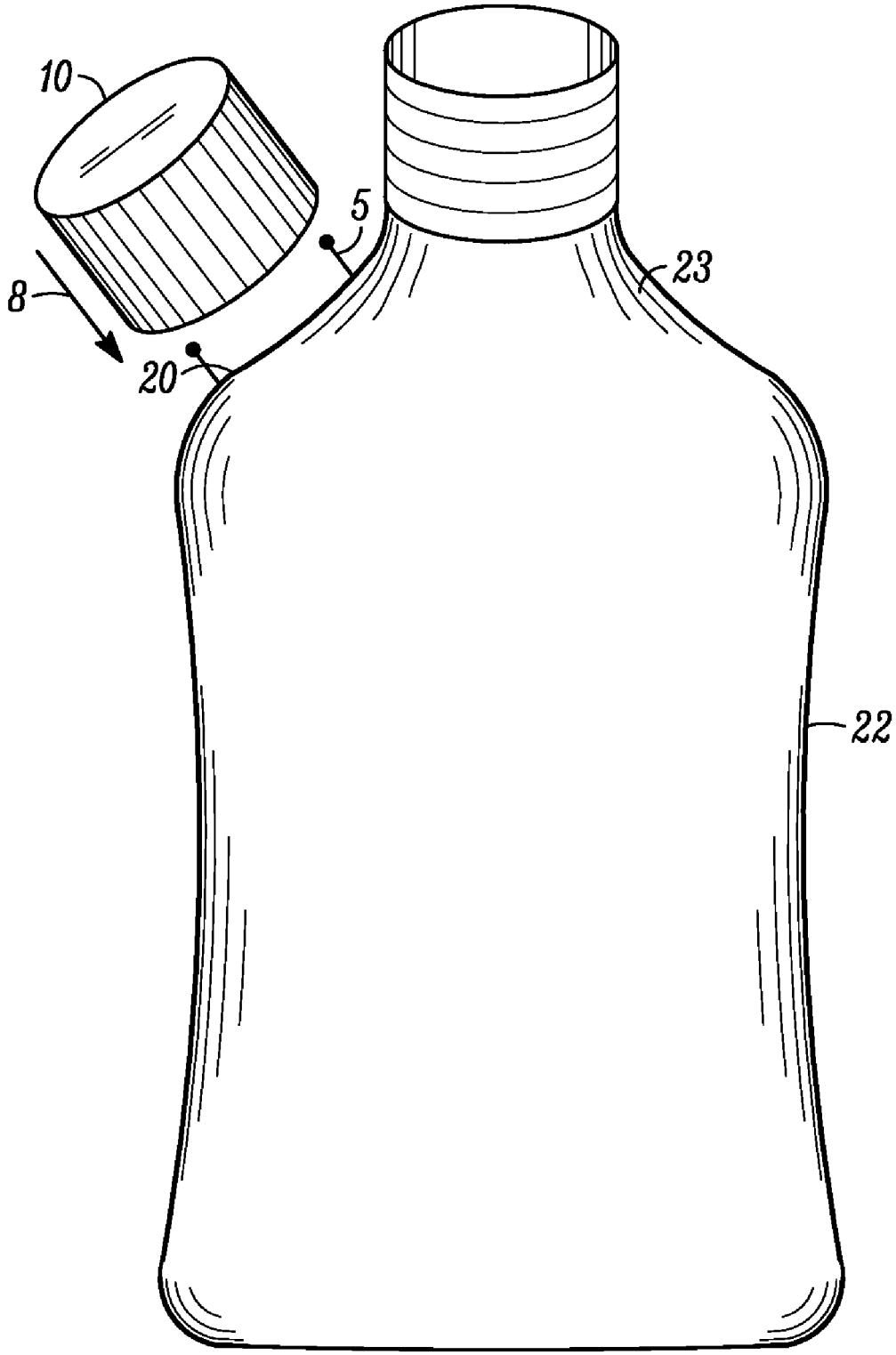
FIG. 5 is a perspective view of a bottle with protrusions of another embodiment holding a cap.

In FIG. 5 an alternate embodiment is shown. In this embodiment there are two protrusions 5 spaced apart to just hold a sidewall of cap 10 when cap 10 is pressed indirection 8 on to the container surface 20 of container 22. Note once again the protrusions are molded into the shoulder 23 of container 22 however any place on the surface 22 of the container 22 can be used although it is clear that some positions may be more preferable than others both from a use standpoint as well as a manufacturing standpoint.

The specific examples and drawings shown are designed to depict specific embodiments of the present invention and are not intended to be limiting in scope. One skilled in the art in view of the disclosure of the present invention could select other shapes and sizes of protrusions locations of protrusions, cap grabbing means and the like based on the present disclosure and the claims which follow are to be so interpreted.

What I claim is:

1. A plastic soda type bottle having an opening sealed by a removable round flexible plastic screw cap, the cap comprising a circular selected open inner circumference and an inner diameter, the bottle having a cap holder consisting of:

a) a first protrusion; and b) a second protrusion;

wherein the first and second protrusions are positioned on the surface of the bottle where they do not interfere with bottle use and wherein each are spaced so that they are positioned on the bottle at a distance of about at or slightly further apart than the inner diameter of the cap, such that the cap open inner circumference fits over the first and second protrusions and contacts the first and second protrusions on a surface of the cap's inner circumference and is held in place wherein the first and second protrusion are positioned slightly further apart than the inner diameter of the cap such that the cap will only fit over the protrusions by deforming the cap to an oval shape.

2. A soda bottle according to claim 1 wherein each protrusion has a diameter of from about 0.5 mm to about 2 mm.

3. A soda bottle according to claim 2 wherein the first and second protrusion are modified into the bottles as part of the bottle.

4. A soda type bottle according to claim 3 wherein the cap grabbing means comprises a bulbous end.

5. A soda type bottle according to claim 1 where at least one protrusion further comprises a cap grabbing means.

6. A cap holder according to claim 1 wherein the first and second protrusion are positioned on the bottle shoulder wherein it does not interfere with bottle use.

7. A plastic soda type bottle having an opening sealed by a removable flexible plastic round screw cap, the cap comprising a side wall with a selected side wall thickness, the bottle having a cap holder molded onto the surface of the bottle as part of the bottle consisting of:

a) a first protrusion; and b) a second protrusion;

wherein the first and second protrusion spaced apart at no greater than about the selected sidewall thickness such that the cap side wall when placed in between the first and second protrusion will be held in place and positioned such that it will not interfere with the bottle use.

8. A cap holder according to claim 7 wherein the protrusions further comprise a cap grabbing means.

9. A cap holder according to claim 7 wherein the protrusions are molded into the shoulder of the bottle.

10. A plastic soda type bottle having an opening sealed by a removable round plastic screw cap, the cap comprising an inside sidewall and an outside sidewall wherein the side wall comprises a selected sidewall thickness, the bottle having a cap holder consisting of:

a) a first pair of spaced protrusions; and b) a second pair of spaced protrusions;

wherein each pair is positioned on the bottle's surface where it will not interfere with bottle use and spaced apart at the selected sidewall thickness such that one protrusion is in contact with the outside side wall and the other protrusion in contact with the opposing inner side wall when the cap holder is holding the cap.

11. A soda type bottle according to claim 10 wherein the protrusions further comprise a cap grabbing means.

12. A soda type bottle according to claim 10 wherein the protrusions are arranged linearly.

* * * * *